US011282440B2

(12) United States Patent
Jeong et al.

(10) Patent No.: US 11,282,440 B2
(45) Date of Patent: Mar. 22, 2022

(54) DISPLAY DEVICE

(71) Applicant: Samsung Display Co., Ltd., Yongin-si (KR)

(72) Inventors: Il Hun Jeong, Yongin-si (KR); Hai Jung In, Yongin-si (KR); Yeon Shil Jung, Yongin-si (KR); Hae Goo Jung, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/008,308

(22) Filed: Aug. 31, 2020

(65) Prior Publication Data

US 2021/0264847 A1 Aug. 26, 2021

(30) Foreign Application Priority Data

Feb. 21, 2020 (KR) ..... 10-2020-0021719

(51) Int. Cl.
*G09G 3/32* (2016.01)
*G09G 3/20* (2006.01)

(52) U.S. Cl.
CPC ..... *G09G 3/32* (2013.01); *G09G 3/2003* (2013.01); *G09G 2310/027* (2013.01); *G09G 2320/0276* (2013.01); *G09G 2330/028* (2013.01)

(58) Field of Classification Search
CPC .. G09G 3/32; G09G 3/2003; G09G 2310/027; G09G 2320/066; G09G 2320/0276; G09G 2330/028
See application file for complete search history.

(56) References Cited

U.S. PATENT DOCUMENTS

| | | | | |
|---|---|---|---|---|
| 10,157,562 | B2 | 12/2018 | Shin et al. | |
| 10,789,890 | B2 * | 9/2020 | Kang | G09G 3/3258 |
| 2006/0066532 | A1 * | 3/2006 | Jeong | G09G 3/3233 345/76 |
| 2012/0001893 | A1 * | 1/2012 | Jeong | G09G 3/3233 345/213 |
| 2012/0001896 | A1 * | 1/2012 | Han | G09G 3/3233 345/214 |
| 2015/0187270 | A1 * | 7/2015 | Lee | G09G 3/3266 345/76 |
| 2016/0064700 | A1 * | 3/2016 | Pyon | H01L 51/56 257/40 |

(Continued)

FOREIGN PATENT DOCUMENTS

| | | | |
|---|---|---|---|
| KR | 10-0692000 | B1 | 3/2007 |
| KR | 10-1588449 | B1 | 1/2016 |

(Continued)

*Primary Examiner* — Kenneth Bukowski
(74) *Attorney, Agent, or Firm* — Lewis Roca Rothgerber Christie LLP

(57) ABSTRACT

A display device includes: a display panel including a pixel electrically connected to each of a data line, a first power line, a second power line, and a third power line; a power supply to provide a first power voltage to the first power line, and a second power voltage to the second power line; and a driver to provide a data voltage to the data line, and a third power voltage to the third power line. The driver is to determine whether a sensing voltage measured at the second power line is out of a reference range, and to limit the supply of the third power voltage when the sensing voltage is out of the reference range.

19 Claims, 12 Drawing Sheets

(56) References Cited

U.S. PATENT DOCUMENTS

| | | | | |
|---|---|---|---|---|
| 2018/0061293 | A1* | 3/2018 | Park | G09G 3/3225 |
| 2018/0324373 | A1* | 11/2018 | Kim | H04N 5/30 |
| 2019/0189053 | A1* | 6/2019 | Kim | G09G 3/3233 |
| 2020/0251045 | A1* | 8/2020 | An | H02H 7/20 |
| 2021/0065648 | A1* | 3/2021 | Choi | G09G 3/3688 |

FOREIGN PATENT DOCUMENTS

| | | | |
|---|---|---|---|
| KR | 10-2018-0112435 | A | 10/2018 |
| KR | 10-1929037 | B1 | 12/2018 |
| KR | 10-1983368 | B1 | 5/2019 |

* cited by examiner

DISPLAY DEVICE

CROSS-REFERENCE TO RELATED APPLICATION

This application claims priority to and the benefit of Korean patent application 10-2020-0021719, filed on Feb. 21, 2020 in the Korean Intellectual Property Office, the entire disclosure of which is incorporated by reference herein.

BACKGROUND

1. Field

Aspects of example embodiments of the present disclosure generally relate to a display device.

2. Related Art

A display device includes a display panel and a driver. The display panel includes scan lines, data lines, and a plurality of pixels. Each of the pixels includes a light emitting element connected between a plurality of driving power sources, and a pixel circuit that provides a driving current to the light emitting element. The driver includes a scan driver that sequentially provides a scan signal to the scan lines, and a data driver that provides a data signal to the data lines. Each of the pixels emits light having a luminance corresponding to a data signal provided through a corresponding data line in response to a scan signal provided through a corresponding scan line.

In order to improve a contrast ratio, the display device may periodically initialize the light emitting element (e.g., an anode electrode of the light emitting element) of each of the pixels by using an initialization power source of the driver.

When a defect occurs in a connection between the light emitting element (or the display panel) and the driving power sources (e.g., a driving power source connected to a cathode electrode of the light emitting element), for example, a failure occurring in a line or a connector to which the driving power source is applied, the driving current may flow through the initialization power source instead of the light emitting element, and the driver may be damaged.

The above information disclosed in this Background section is for enhancement of understanding of the background of the present disclosure, and therefore, it may contain information that does not constitute prior art.

SUMMARY

One or more example embodiments of the present disclosure are directed to a display device capable of preventing or substantially preventing damage of a driver, which may be caused by a failure of one or more driving power sources.

According to one or more example embodiments of the present disclosure, a display device includes: a display panel including a pixel electrically connected to each of a data line, a first power line, a second power line, and a third power line; a power supply configured to provide a first power voltage to the first power line, and a second power voltage to the second power line; and a driver configured to provide a data voltage to the data line, and a third power voltage to the third power line. The driver is configured to determine whether a sensing voltage measured at the second power line is out of a reference range, and to limit the supply of the third power voltage when the sensing voltage is out of the reference range.

In an example embodiment, the pixel may include: a light emitting element connected between the first power line and the second power line; a driving current generating circuit configured to provide a driving current from the first power line to the light emitting element in response to the data voltage; and an initialization transistor connected between the third power line and one electrode of the light emitting element.

In an example embodiment, the driver may be configured to measure the sensing voltage through a routing line branching off from the second power line.

In an example embodiment, the display device may further include a switch connected between the third power line of the display panel and the driver, and the driver may be configured to generate a control signal for turning off the switch when the sensing voltage is out of the reference range.

In an example embodiment, the driver may include: an analog-digital converter configured to convert the sensing voltage into a sensing value in a digital form; a comparator configured to compare the sensing value with a reference value; and a control signal generator configured to generate the control signal based on a comparison result of the comparator.

In an example embodiment, the driver may include: a reference voltage generator configured to generate a reference voltage; a comparator configured to compare the sensing voltage with the reference voltage; and a control signal generator configured to generate the control signal based on a comparison result of the comparator.

In an example embodiment, the driving current generating circuit may include: a first transistor including a first electrode electrically connected to the first power line through a second node, a second electrode electrically connected to the one electrode of the light emitting element through a first node, and a gate electrode electrically connected to a third node; a second transistor including a first electrode connected to the data line, a second electrode connected to the second node, and a gate electrode connected to a scan line; a third transistor including a first electrode connected to the first node, a second electrode connected to the third node, and a gate electrode connected to the scan line; and a storage capacitor between the first power line and the third node.

In an example embodiment, the driving current generating circuit may include: a first transistor including a first electrode electrically connected to the first power line, a second electrode electrically connected to the one electrode of the light emitting element, and a gate electrode connected to a gate node; a second transistor including a first electrode connected to the data line, a second electrode connected to the gate node, and a gate electrode connected to a scan line; and a storage capacitor between the gate node and the one electrode of the light emitting element.

In an example embodiment, the display device may further include a current limiting circuit connected between the third power line of the display panel and the driver, and the driver may be configured to generate a control signal to allow the current limiting circuit to limit an amount of current flowing through the third power line, when the sensing voltage is out of the reference range.

In an example embodiment, the driver may be configured to vary the third power voltage when the sensing voltage is out of the reference range.

In an example embodiment, the driver may be configured to increase a voltage level of the third power voltage when the sensing voltage is out of the reference range.

In an example embodiment, a voltage level of the first power voltage may be greater than that of the second power voltage.

According to one or more example embodiments of the present disclosure, a display device includes: a display panel including a pixel electrically connected to each of a data line, a first power line, a second power line, and a third power line; a power supply configured to provide a first power voltage to the first power line, and a second power voltage to the second power line; and a driver configured to provide a data voltage to the data line, and a third power voltage to the third power line. The driver is configured to determine whether a sensing voltage measured at the second power line is out of a reference range, and to vary the data voltage from a first voltage range to be within a second voltage range different from the first voltage range.

In an example embodiment, the second voltage range may be a subset of the first voltage range, and the second voltage range may correspond to a low luminance that is lower than an average luminance of the first voltage range.

In an example embodiment, the driver may be configured to change the data voltage to correspond to a minimum grayscale when the sensing voltage is out of the reference range.

In an example embodiment, the display panel may include a plurality of pixels including first pixels configured to emit light of a first color, and second pixels configured to emit light of a second color, and the driver may be configured to change a data voltage of the first pixels to correspond to a minimum grayscale, and a data voltage of the second pixels to correspond to an intermediate grayscale greater than the minimum grayscale.

In an example embodiment, the driver may include: a control circuit configured to determine whether the sensing voltage is out of the reference range; a gamma voltage generating circuit configured to generate gamma voltages, and to vary a voltage range of the gamma voltages based on a determination result of the control circuit; and an analog-digital converter configured to generate the data voltage based on the gamma voltages and a grayscale value included in image data and corresponding to the pixel.

In an example embodiment, the display device may further include a memory configured to store notification data, the driver may be configured to generate the data voltage based on the notification data when the sensing voltage is out of the reference range, and the notification data may correspond to an error image representing that the second power voltage is not normally provided to the second power line.

In an example embodiment, the error image may include a black image, a single color image, a pattern image, or a pattern.

According to one or more example embodiments of the present disclosure, a display device includes: a display panel including a pixel electrically connected to each of a data line, a first power line, a second power line, and a third power line; a power supply configured to provide a first power voltage to the first power line, and a second power voltage to the second power line; and a driver configured to provide a data voltage to the data line, and a third power voltage to the third power line. The driver is configured to determine whether a sensing voltage measured at the second power line is out of a reference range, and to generate a control signal when the sensing voltage is out of the reference range, and the power supply is configured to interrupt the supply of the first power voltage in response to the control signal.

BRIEF DESCRIPTION OF THE DRAWINGS

The above and other aspects and features of the present disclosure will become more apparent to those skilled in the art from the following detailed description of the example embodiments with reference to the accompanying drawings.

DETAILED DESCRIPTION

Figure 1:
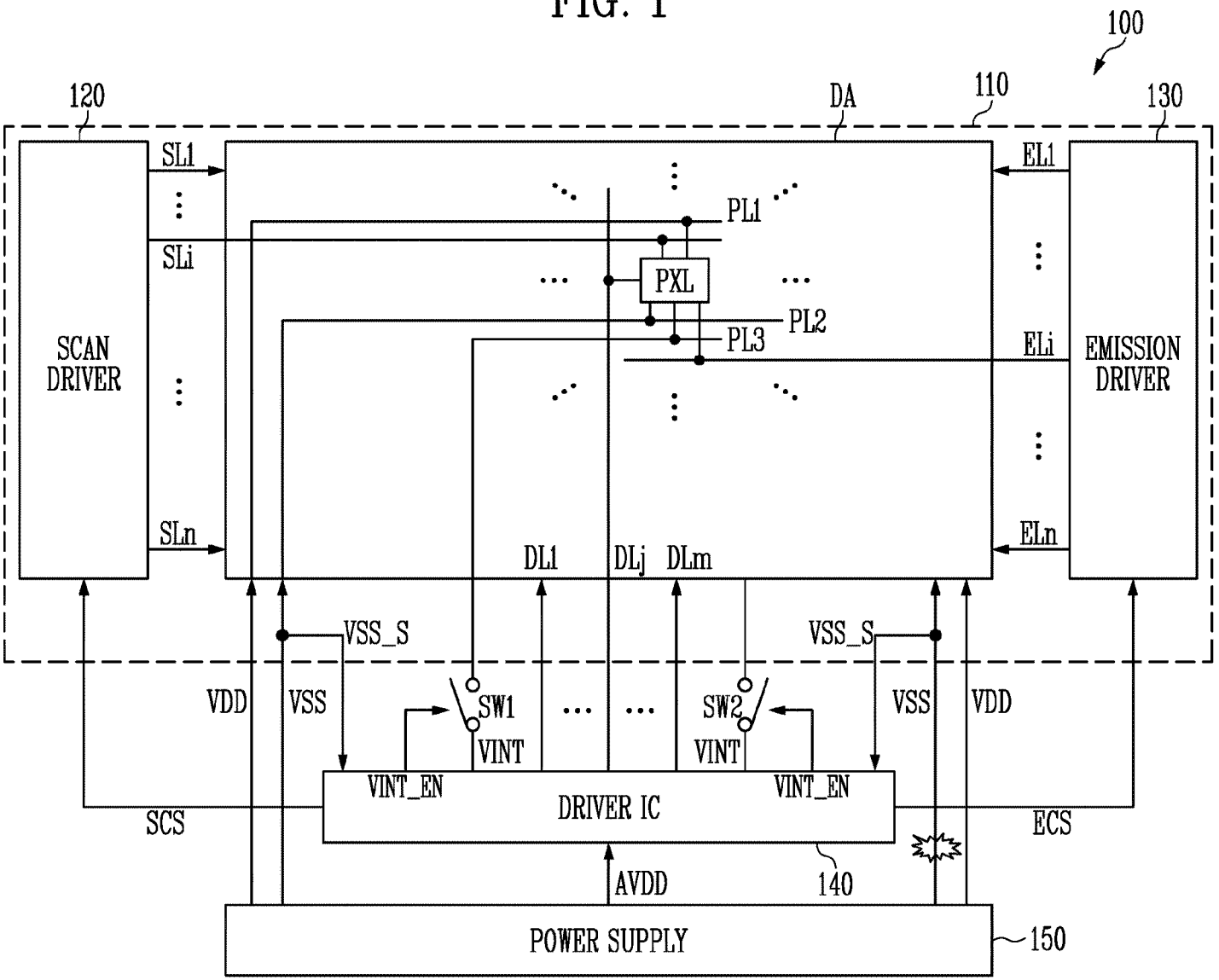
FIG. 1 is a block diagram illustrating a display device in accordance with an embodiment of the present disclosure.

Hereinafter, example embodiments will be described in more detail with reference to the accompanying drawings, in which like reference numbers refer to like elements throughout. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art. Accordingly, processes, elements, and techniques that are not necessary to those having ordinary skill in the art for a complete understanding of the aspects and features of the present disclosure may not be described. Unless otherwise noted, like reference numerals denote like elements throughout the attached drawings and the written description, and thus, descriptions thereof may not be repeated.

In the drawings, the relative sizes of elements, layers, and regions may be exaggerated and/or simplified for clarity. Dimensional relationships among individual elements in the attached drawings are illustrated only for ease of understanding, but do not limit the actual scale thereof. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present disclosure. As used herein, the singular forms "a" and "an" are intended to include the plural forms as well, unless the context clearly indicates otherwise. It will be further understood that the terms "comprises," "comprising," "includes," and "including," "has," "have," and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present disclosure refers to "one or more embodiments of the present disclosure." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a display device in accordance with an embodiment of the present disclosure.

Referring to FIG. 1, the display device 100 may include a display 110 (e.g., a display panel), a scan driver 120 (e.g., a scan driving circuit or a first gate driver), an emission driver 130 (e.g., an emission driving circuit or a second gate driver), a driver 140 (e.g., a driver integrated circuit (IC)), and a power supply 150.

The display 110 may include a plurality of scan lines (e.g., a plurality of gate lines) SL1 to SLn (where n is a positive integer), a plurality of data lines DL1 to DLm (where m is a positive integer), a plurality of emission control lines EL1 to ELn, and a plurality of pixels PXL. The pixels PXL may be arranged at (e.g., in or on) areas (e.g., pixel areas) defined by the scan lines SL1 to SLn and the data lines DL1 to DLm at (e.g., in or on) a display area DA.

Each of the pixels PXL may be connected to at least one of the scan lines SL1 to SLn, one of the data lines DL1 to DLm, and at least one of the emission control lines EL1 to ELn. Hereinafter, the term "connection" may refer to an electrical connection. For example, the pixel PXL may be connected to a scan line SLi, a data line DLj, and an emission control line ELi (where each of i and j is a positive integer). Further, the pixel PXL may be connected to a first power line PL1, a second power line PL2, and a third power line PL3.

The pixel PXL may store or record a data signal (e.g., a data voltage) provided through the data line DLj in response to a scan signal (e.g., a gate signal) provided through the scan line SLi. The pixel PXL may emit light having a desired luminance corresponding to the stored data signal in response to an emission control signal provided through the emission control line ELi.

The display 110 may further include the first power line PL1, the second power line PL2, and the third power line PL3. A first power voltage VDD may be applied to the first power line PL1, and the first power line PL1 may be a common line connected to a plurality of the pixels PXL. A second power voltage VSS may be applied to the second power line PL2, and the second power line PL2 may be a common line connected to a plurality of the pixels PXL. An initialization voltage VINT (e.g., an initialization power voltage or a third power voltage) may be applied to the third power line PL3, and the third power line PL3 may be a common line connected to a plurality of the pixels PXL. The first power voltage VDD and the second power voltage VSS may be suitable voltages (e.g., voltages used) for an operation of the pixel PXL, and the first power voltage VDD may have a voltage level higher than that of the second power voltage VSS. The initialization voltage VINT may be a voltage used to initialize the pixel PXL (e.g., to initialize a light emitting element in the pixel PXL, and/or to initialize a parasitic capacitor of the light emitting element).

The scan driver 120 may generate a scan signal based on a scan control signal SCS (e.g., a gate control signal), and may sequentially provide the scan signal to the scan lines SL1 to SLn. The scan control signal SCS may include a scan start signal, scan clock signals, and/or the like, and may be provided from the driver 140 (e.g., a timing controller). For example, the scan driver 120 may include a shift register (or a stage) to sequentially generate and output a scan signal in a pulse form, which may correspond to the scan start signal in a pulse form, by using the scan clock signals.

The emission driver 130 may generate an emission control signal based on an emission driving control signal ECS, and may sequentially provide the emission control signal to the emission control lines EL1 to ELn. The emission driving control signal ECS may include an emission start signal, emission clock signals, and/or the like, and may be provided from the driver 140 (e.g., the timing controller). For example, the emission driver 130 may include a shift register to sequentially generate and output an emission control signal in a pulse form, which may correspond to the emission start signal in a pulse form, by using the emission clock signals.

However, the present disclosure is not limited thereto, for example, in some embodiments, the emission driver 130 may be omitted according to a desired or suitable circuit structure of the pixel PXL.

At least one of the scan driver 120 and the emission driver 130 may be formed at (e.g., in or on) the display 110, or may be implemented with an IC to be connected to the display 110 through a circuit board (e.g., a flexible circuit board).

Although FIG. 1 shows a case where the scan driver 120 and the emission driver 130 are located at (e.g., in or on) different sides (e.g., different directions) with respect to the display 110, the present disclosure is not limited thereto, and the scan driver 120 and the emission driver 130 may be located at (e.g., in or on) the same side (e.g., the same direction) with respect to the display 110, and/or may be implemented with a single IC.

The power supply 150 may generate a first power voltage VDD and a second power voltage VSS, and may provide the first power voltage VDD and the second power voltage VSS to the display 110. Further, the power supply 150 may generate a gamma power voltage AVDD, and may provide the gamma power voltage AVDD to the driver 140. The gamma power voltage AVDD may be a voltage used for an operation of the driver 140. For example, the power supply 150 may be implemented with a Power Management Integrated Circuit (PMIC).

The driver 140 may receive input image data and a control signal from the outside (e.g., from a graphic processor), may generate the scan control signal SCS and the emission driving control signal ECS based on the control signal, and may convert the input image data into image data corresponding to an arrangement of the pixels PXL at (e.g., in or on) the display 110. For example, the driver 140 may convert input image data in an RGB format into image data in an RGB format.

Further, the driver 140 may generate data signals based on the image data, and may provide the data signals to the display 110 (e.g., to the pixels PXL). For example, the driver 140 may receive the gamma power voltage AVDD, may generate gamma voltages based on the gamma power voltage AVDD, and may generate data signals (e.g., a data voltage corresponding to a grayscale value included in the image data) based on the image data (e.g., the grayscale value) and the gamma voltages.

The driver 140 may generate an initialization voltage VINT, and may provide the initialization voltage VINT to the third power line PL3 of the display 110.

The driver 140 may include a timing controller to generate the scan control signal SCS, the emission driving control signal ECS, and the image data, and a data driver (e.g., a data driving circuit) to generate the data signals and the initialization voltage VINT. In some embodiments, the driver 140 may be implemented with a single IC. The driver 140 may be mounted on a circuit board (e.g., a flexible circuit board) to be connected to the display 110.

In some embodiments, the driver 140 may control and/or may limit the supply of the initialization voltage VINT based on a sensing voltage VSS_S, which may be measured at the second power line PL2 of the display 110 (e.g., a voltage level of the second power voltage VSS that is actually applied to the display 110). For example, a routing line that branches off from the second power line PL2 of the display 110 may be connected to an input terminal for receiving the sensing voltage VSS_S of the driver 140. However, the present disclosure is not limited thereto. For example, in some embodiments, the driver 140 may measure the sensing voltage VSS_S at the outside of the display 110, or at an output terminal of the power supply 150. For example, the driver 140 may determine whether the sensing voltage VSS_S is out of a reference range (e.g., an allowable range), and may interrupt the supply of the initialization voltage VINT when the sensing voltage VSS_S is out of the reference range. In other words, the driver 140 may determine whether the second power voltage VSS is normally supplied to the display 110, and may interrupt the initialization voltage VINT applied to the third power line PL3 when the second power voltage VSS is not supplied (e.g., is not normally supplied) to the display 110.

For example, an electrical disconnection between the power supply 150 and the display 110 may occur due to an external impact, a connector failure, and/or the like. As shown in FIG. 1, for example, a line adjacent to the emission driver 130 (e.g., a line to which the second power voltage VSS is applied) may be open. In this case, the second power voltage VSS (or only the second power voltage VSS) may not be provided from the power supply 150 to the display 110, or may be abnormally supplied. As will be described in more detail below with reference to FIG. 2, when the second power voltage VSS is not supplied, the second power line PL2 may be floated, and a driving current may not flow in the second power line PL2 from the first power line PL1 through the pixel PXL. The driving current, which does not flow in the second power line PL2, may increase a voltage of a node (e.g., a particular node or a specific node) in the pixel PXL (e.g., an anode electrode of the light emitting element of the pixel PXL), and an overcurrent may flow in the driver 140 through the third power line PL3 connected to the node due to the increased voltage of the node. In this case, continuously generated overcurrent may increase a temperature of the driver 140, may cause a malfunction of the driver 140, and/or may further cause a malfunction of and/or damage to the display 110 driven by the driver 140.

Therefore, the driver 140 (or the display device 100) may be disconnected from the third power line PL3 when the second power voltage VSS is not applied (or is abnormally applied) to the second power line PL2 of the display 110. Thus, damage to the driver 140 (and damage to the display 110) may be prevented or substantially prevented.

In an embodiment, the display device 100 may include at least one protection circuit (e.g., an overcurrent protection circuit) connected between the third power line PL3 of the display 110 and the driver 140, and the at least one protection circuit may include at least one switch. For example, when the display 110 receives the initialization voltage VINT through a plurality of input terminals, the display device 100 may include a plurality of switches (e.g., a first switch SW1 and a second switch SW2).

In an embodiment, when the sensing voltage VSS_S is out of the reference range, the driver 140 may generate an initialization voltage control signal VINT_EN (e.g., an initialization enable signal) for operating at least one protection circuit. For example, when the sensing voltage VSS_S is out of the reference range, the driver 140 may generate the initialization voltage control signal VINT_EN (e.g., a switch control signal) for turning off at least one switch. For example, the first switch SW1 and the second switch SW2 may be turned off in response to the initialization voltage control signal VINT_EN (e.g., the initialization voltage control signal VINT_EN having a turn-off voltage level), and the third power line PL3 of the display 110 and the driver 140 may be electrically disconnected. In other words, a path through which an overcurrent may move to the driver 140 through the third power line PL3 of the display 110 may be interrupted.

Although FIG. 1 shows a case where the at least one protection circuit (e.g., the first switch SW1 and the second switch SW2) is independent from the display 110 and the driver 140, and is provided separately from the display 110 and the driver 140, the present disclosure is not limited thereto. For example, the at least one protection circuit (e.g., the first switch SW1 and the second switch SW2) may be implemented (e.g., may be built) in the driver 140, or may be formed at (e.g., in or on) one area of the display 110 (e.g., at a non-display area between the display area DA and the driver 140).

As described with reference to FIG. 1, when the second power voltage VSS is not normally supplied to the display 110, the display device 100 supplies the initialization voltage VINT to the third power line PL3 of the display 110 through the driver 140, and interrupts the initialization voltage VINT applied to the third power line PL3 from the driver 140 through the protection circuit (e.g., the first switch SW1 and the second switch SW2). Thus, damage to the driver 140 (and damage to the display device 100) may be prevented or substantially prevented.

Although a case where the protection circuit (e.g., the first switch SW1 and the second switch SW2) is formed between the driver 140 and the display 110 (or the third power line PL3) is illustrated in FIG. 1, the present disclosure is not limited thereto. For example, when the display 110 further includes a power line connected to a particular or specific node (e.g., a node at which a voltage level may increase due to a connection error of the second power voltage VSS, or a node at which an overcurrent may be generated) in the pixel PXL, the protection circuit may be formed between the power line and a power source (e.g., a power source for supplying a separate power voltage to the power line).

Figure 2:
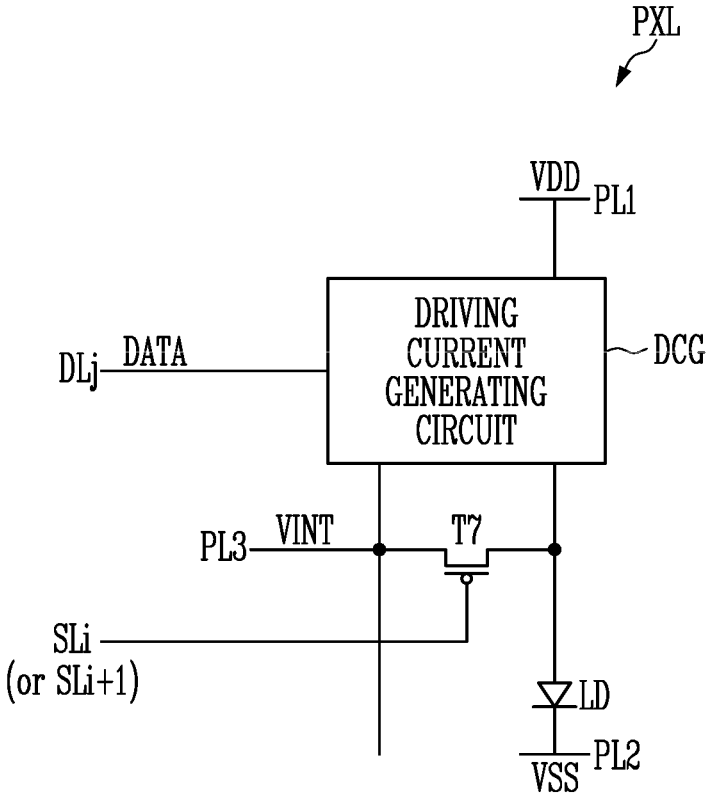
FIG. 2 is a diagram illustrating an example of a pixel included in the display device shown in FIG. 1.

FIG. 2 is a diagram illustrating an example of the pixel included in the display device shown in FIG. 1.

Referring to FIGS. 1 and 2, the pixel PXL may include a light emitting element (e.g., a light emitting device) LD, a driving current generating circuit DCG, and a seventh transistor T7 (e.g., an initialization transistor).

The light emitting element LD may be connected to the first power line PL1 and the second power line PL2. For example, an anode electrode of the light emitting element LD may be connected to the first power line PL1 through the driving current generating circuit DCG, and a cathode electrode of the light emitting element LD may be connected to the second power line PL2. In some embodiments, the light emitting element LD may be implemented with an organic light emitting diode. However, the present disclosure is not limited thereto, and the light emitting element LD may be implemented with any suitable kind of light emitting device, for example, such as an inorganic light emitting element or the like.

The driving current generating circuit DCG may be connected between the first power line PL1 and the light emitting element LD (e.g., the anode electrode of the light emitting element LD), and may provide a driving current to the light emitting element LD in response to a data signal DATA (e.g., a data voltage) provided through a data line DLj. The light emitting element LD may emit light having a desired luminance corresponding to the driving current provided from the driving current generating circuit DCG. A detailed configuration of the driving current generating circuit DCG will be described below with reference to FIGS. 3A and 3B.

The seventh transistor T7 (e.g., the initialization transistor) may be connected between the third power line PL3 and a path through which the driving current moves. For example, a first electrode (e.g., one electrode) of the seventh transistor T7 may be connected to the third power line PL3, a second electrode (e.g., the other electrode) of the seventh transistor T7 may be connected to the anode electrode of the light emitting element LD, and a gate electrode of the seventh transistor T7 may be connected a scan line SLi (or a next scan line SLi+1 adjacent to the scan line SLi). The seventh transistor T7 may be turned on when a scan signal is supplied to the scan line SLi (or to the next scan line SLi+1), to supply the initialization voltage VINT to the anode electrode of the light emitting element LD.

When the initialization voltage VINT is supplied to the anode electrode of the light emitting element LD, a parasitic capacitor of the light emitting element LD may be discharged. When a remaining voltage charged in the parasitic capacitor is discharged (e.g., is removed), an unintended minute emission may be prevented or substantially prevented. Thus, black expression ability of the pixel PXL may be improved.

The seventh transistor T7 may be implemented with a P-type transistor, but the present disclosure is not limited thereto. For example, the seventh transistor T7 may be implemented with an N-type transistor.

As described with reference to FIG. 1, when the second power voltage VSS is not provided to the second power line PL2 from the power supply 150, the second power line PL2 may be floated. In this case, the driving current provided from the driving current sensing circuit DCG may not normally flow to the second power line PL2 through the light emitting element LD, and the light emitting element LD may not emit light or may abnormally emit light (e.g., may emit light having an undesired luminance). The driving current that does not flow to the second power line PL2 may increase a voltage at the anode electrode of the light emitting element LD (e.g., at a node connected to the anode electrode of the light emitting element LD). In this case, when the seventh transistor T7 is turned on, the anode electrode of the light emitting element LD and the third power line PL3 may be connected to each other, and an overcurrent may flow in the third power line PL3 due to the voltage increased at the anode electrode of the light emitting element LD. Therefore, as described with reference to FIG. 1, the driver 140 (or the display device 100) may be disconnected from the third power line PL3, when the second power voltage VSS is not applied (or is abnormally applied) to the second power line PL2. Thus, damage to the driver 140 (and damage to the display 110) may be prevented or substantially prevented.

Figure 3A:
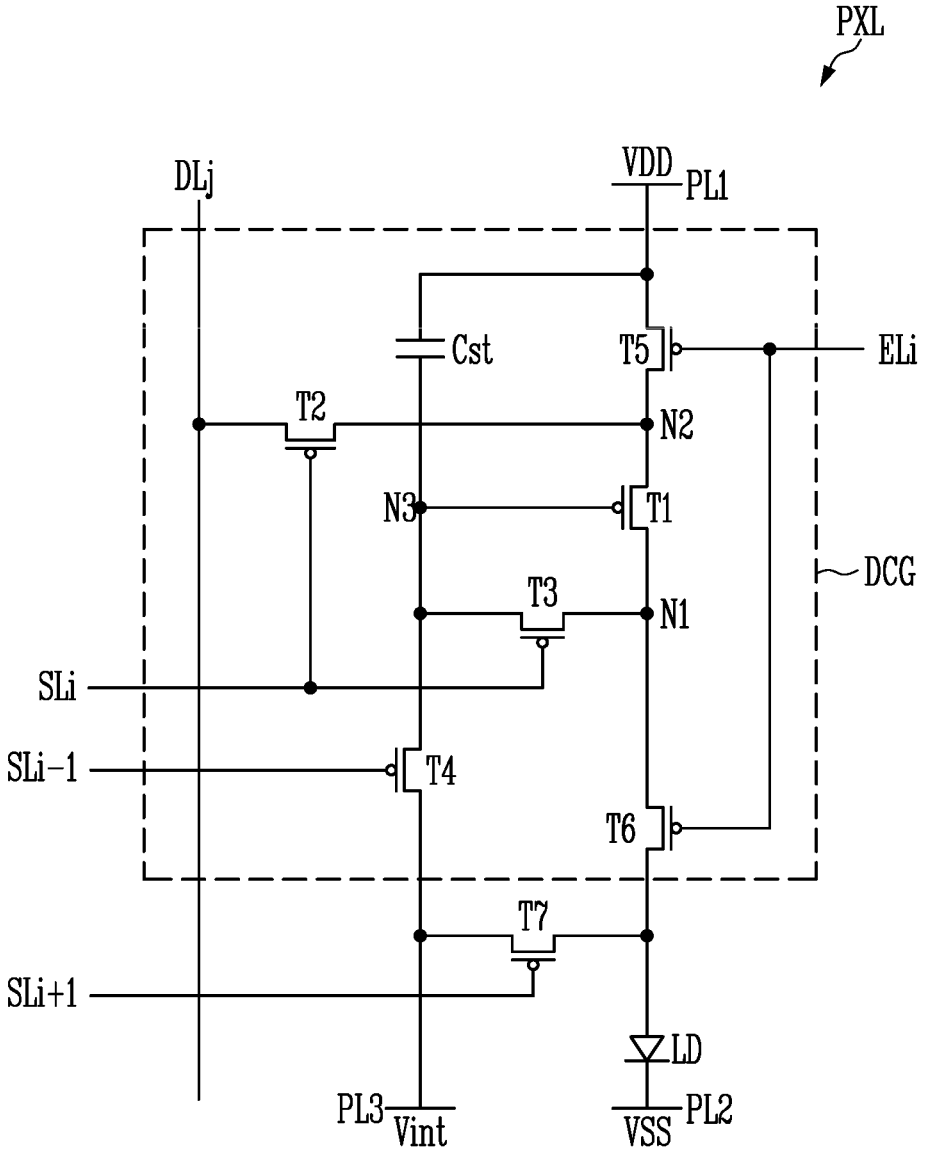
FIG. 3A is a circuit diagram illustrating an example of the pixel shown in FIG. 2.

FIG. 3A is a circuit diagram illustrating an example of the pixel shown in FIG. 2.

Referring to FIGS. 2 and 3A, the pixel PXL may include first to seventh transistors T1 to T7, a storage capacitor Cst, and a light emitting element LD. A driving current generating circuit DCG may include the first to sixth transistors T1 to T6 and the storage capacitor Cst.

Each of the first to seventh transistors T1 to T7 may be implemented with a P-type transistor, but the present disclosure is not limited thereto. For example, in some embodiments, at least one of the first to seventh transistors T1 to T7 may be implemented with an N-type transistor.

A first electrode of the first transistor T1 (e.g., a driving transistor) may be connected to a second node N2, and/or may be connected to the first power line PL1 via the fifth transistor T5. A second electrode of the first transistor T1 may be connected to a first node N1, and/or may be connected to an anode electrode of the light emitting element LD via the sixth transistor T6. A gate electrode of the first transistor T1 may be connected to a third node N3. The first transistor T1 may control a driving current (e.g., an amount of current) flowing to the second power line PL2 via the light emitting element LD from the first power line PL1, corresponding to (e.g., according to) a voltage of the third node N3.

The second transistor T2 may be connected between a data line DLj and the second node N2. A gate electrode of the second transistor T2 may be connected to a scan line SLi. The second transistor T2 may be turned on when a scan signal (e.g., a scan signal having a gate-on voltage level) is supplied to the scan line SLi, to electrically connect the data line DLj and the first electrode of the first transistor T1 to each other.

The third transistor T3 may be connected between the first node N1 and the third node N3. A gate electrode of the third transistor T3 may be connected to the scan line SLi. The third transistor T3 may be turned on when a scan signal is supplied to the scan line SLi, to electrically connect the first node N1 and the third node N3 to each other. Therefore, the first transistor T1 may be connected in a diode form, when the third transistor T3 is turned on. In other words, when the third transistor T3 is turned on, the first transistor T1 may be diode-connected.

The storage capacitor Cst may be connected and/or formed between the first power line PL1 and the third node N3. The storage capacitor Cst may store a voltage corresponding to a data signal and a threshold voltage of the first transistor T1.

The fourth transistor T4 may be connected between the third node N3 and the third power line PL3. A gate electrode of the fourth transistor T4 may be connected to a previous scan line SLi−1. The fourth transistor T4 may be turned on when a scan signal is supplied to the previous scan line SLi−1, to supply the initialization voltage VINT to the third node N3.

The fifth transistor T5 may be connected between the first power line PL1 and the second node N2. A gate electrode of the fifth transistor T5 may be connected to an emission control line ELi. The fifth transistor T5 may be turned off when an emission control signal (e.g., an emission control signal having a gate-off voltage level) is supplied to the emission control line ELi, and may be turned on in other cases.

The sixth transistor T6 may be connected between the first node N1 and the light emitting element LD. A gate electrode of the sixth transistor T6 may be connected to the emission control line ELi. The sixth transistor T6 may be turned off when an emission control signal (e.g., the emission control signal having a gate-off voltage level) is supplied to the emission control line ELi, and may be turned on in other cases.

Figure 3B:
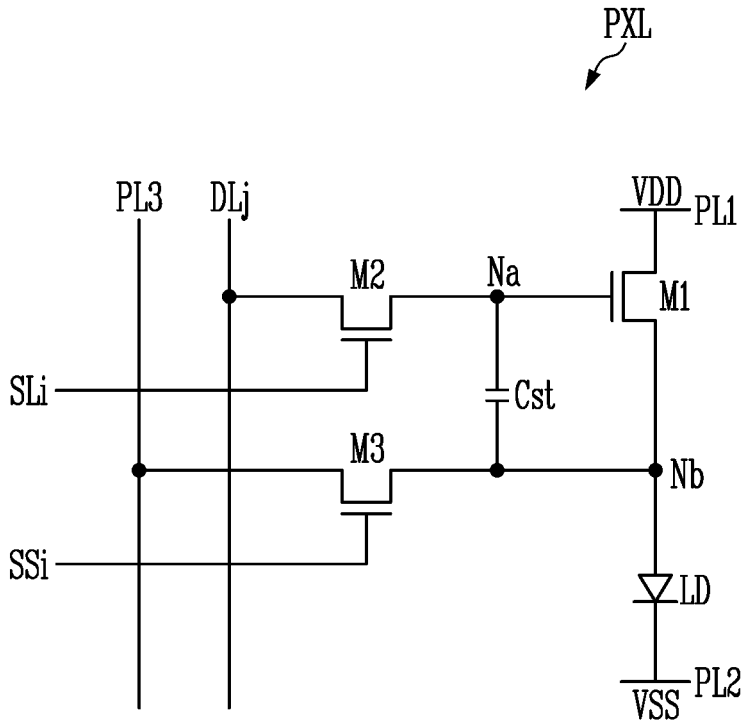
FIG. 3B is a circuit diagram illustrating another example of the pixel shown in FIG. 2.

FIG. 3B is a circuit diagram illustrating another example of the pixel shown in FIG. 2.

Referring to FIG. 3B, the pixel PXL may include a first thin film transistor M1 (e.g., a first transistor), a second thin film transistor M2 (e.g., a second transistor), a third thin film transistor M3 (e.g., an initialization transistor), a storage capacitor Cst, and a light emitting element LD. The third thin film transistor M3 may correspond to the seventh transistor T7 described above with reference to FIG. 2, and a sensing scan line SSi may correspond to the emission control line ELi described above with reference to FIG. 3A. The first thin film transistor M1, the second thin film transistor M2, and the storage capacitor Cst may constitute the driving current generating circuit DCG described above with reference to FIG. 2.

Each of the first to third transistors M1 to M3 may be implemented with an N-type transistor, but the present disclosure is not limited thereto. For example, in some embodiments, at least one of the first to third transistors M1 to M3 may be implemented with a P-type transistor.

A gate electrode of the first thin film transistor M1 (e.g., the driving transistor) may be connected to a gate node Na, a first electrode (e.g., one electrode) of the first thin film transistor M1 may be connected to the first power line PL1, and a second electrode (e.g., the other electrode) of the first thin film transistor M1 may be connected to a source node Nb.

A gate electrode of the second thin film transistor M2 may be connected to a scan line SLi, a first electrode of the second thin film transistor M2 may be connected to a data line DLj, and a second electrode of the second thin film transistor M2 may be connected to the gate node Na.

A gate electrode of the third thin film transistor M3 may be connected to the sensing scan line SSi, a first electrode of the third thin film transistor M3 may be connected to the third power line PL3 (e.g., or a sensing line), and a second electrode of the third thin film transistor M3 may be connected to the source node Nb.

The storage capacitor Cst may be connected between the gate node Na and the source node Nb.

As described with reference to FIGS. 2, 3A, and 3B, the pixel PXL may include the light emitting element, the driving current generating circuit DCG for providing a driving current to the light emitting element LD, and the seventh transistor T7 (e.g., the initialization transistor) connected to the third power line PL3 and the path through which the driving current moves (e.g., the anode electrode of the light emitting element LD).

Figure 4A:
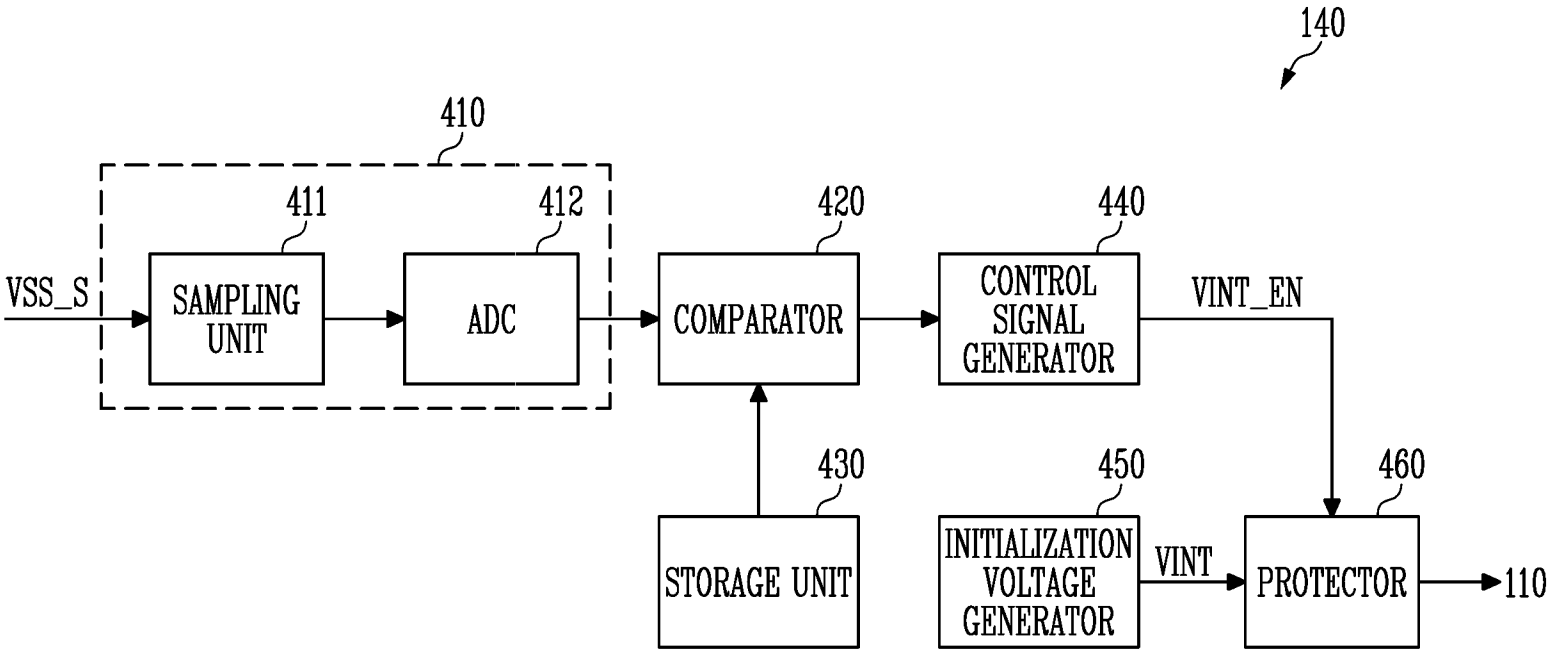
FIG. 4A is a block diagram illustrating an example of a driver included in the display device shown in FIG. 1.

FIG. 4A is a block diagram illustrating an example of a driver included in the display device shown in FIG. 1. The driver 140 is briefly (e.g., is partially) illustrated in FIG. 4A, based on a configuration for controlling the supply of the initialization voltage VINT.

Referring to FIGS. 1 and 4A, a driver 140 may include a sensing unit 410 (e.g., a sensing circuit), a comparator 420 (e.g., a comparison circuit), a storage unit 430 (e.g., a storage circuit), a control signal generator 440 (e.g., a control signal generating circuit), and an initialization voltage generator 450 (e.g., an initialization voltage generating circuit). A protector 460 may correspond to (e.g., may be) the protection circuit (e.g., the first switch SW1 and the second switch SW2) described above with reference to FIG. 1. In the embodiment shown in FIG. 4A, the driver 140 may include the protector 460.

The sensing unit 410 may be connected to the second power line PL2, and may measure a second power voltage VSS (e.g., a sensing voltage VSS_S) at the second power line PL2.

The sensing unit 410 may include a sampling unit 411 (e.g., a sampling circuit), and analog-digital converter (ADC) 412.

The sampling unit 411 may measure the sensing voltage VSS_S by using at least one capacitor and at least one switch (e.g., at least one transistor).

The ADC 412 may convert a voltage (e.g., the sensing voltage VSS_S) provided from the sampling unit 411 into a sensing value (e.g., a digital code). In other words, the ADC 412 may convert the sampled sensing voltage VSS_S from an analog form to a digital form.

The comparator 420 may compare the sensing value provided from the ADC 412 with a reference value (e.g., a reference digital code). The reference value may be determined (e.g., may be predetermined) based on a suitable or desired voltage level or voltage range (e.g., an ideal voltage level or voltage range), and be stored in the storage unit 430. In other words, the driver 140 may determine whether the second power voltage VSS is normally provided to the second power line PL2 through the comparator 420. For example, when the sensing value is less than or equal to the reference value (e.g., when a difference between the sensing value and the reference value is less than an allowable error), the comparator 420 may determine that the second power voltage VSS is normally provided to the second power line PL2. For another example, when the sensing value is greater than the reference value (e.g., when the difference between the sensing value and the reference value is greater than the allowable error), the comparator 420 may determine that the second power voltage VSS is not normally provided to the second power line PL2. In some embodiments, the storage unit 430 may be implemented with a memory device.

The control signal generator 440 may generate an initialization voltage control signal VINT_EN based on a determination result of the comparator 420. For example, when the comparator 420 determines that the second power voltage VSS is normally provided to the second power line PL2, the control signal generator 440 may generate the initialization voltage control signal VINT_EN having a first value. When the initialization voltage control signal VINT_EN has the first value, the protector 460 may not operate (e.g., the first switch SW1 and the second switch SW2 shown in FIG. 1 may maintain or substantially maintain a turn-on state). In this case, the initialization voltage generator 450 may be connected to the display 110 (e.g., to the third power line PL3 of the display 110), and the initialization voltage VINT may be provided to the display 110 from the initialization voltage generator 450. For another example, when the comparator 420 determines that the second power voltage VSS is not normally provided to the second power line PL2, the control signal generator 440 may generate the initialization voltage control signal VINT_EN having a second value. When the initialization voltage control signal VINT_EN has the second value, the protector 460 may operate (e.g., the first switch SW1 and the second switch SW2 shown in FIG. 1 may be turned off). In this case, the initialization voltage generator 450 may be electrically disconnected from the display 110 (e.g., from the third power line PL3 of the display 110), and the supply of the initialization voltage VINT to the display 110 may be interrupted.

The initialization voltage generator 450 may generate the initialization voltage VINT. For example, the initialization voltage generator 450 may be implemented with a DC-DC converter, and may generate the initialization voltage VINT based on the gamma power voltage AVDD (e.g., see FIG. 1).

As described with reference to FIG. 4A, the driver 140 may determine whether the second power voltage VSS is normally provided to the second power line PL2, and may interrupt the initialization voltage VINT applied to the third power line PL3 when the second power voltage VSS is not supplied to the second power line PL2.

Although a case where the driver 140 determines, in a digital manner, whether the second power voltage VSS is normally provided to the second power line PL2 has been described with reference to FIG. 4A, the present disclosure is not limited thereto.

Figure 4B:
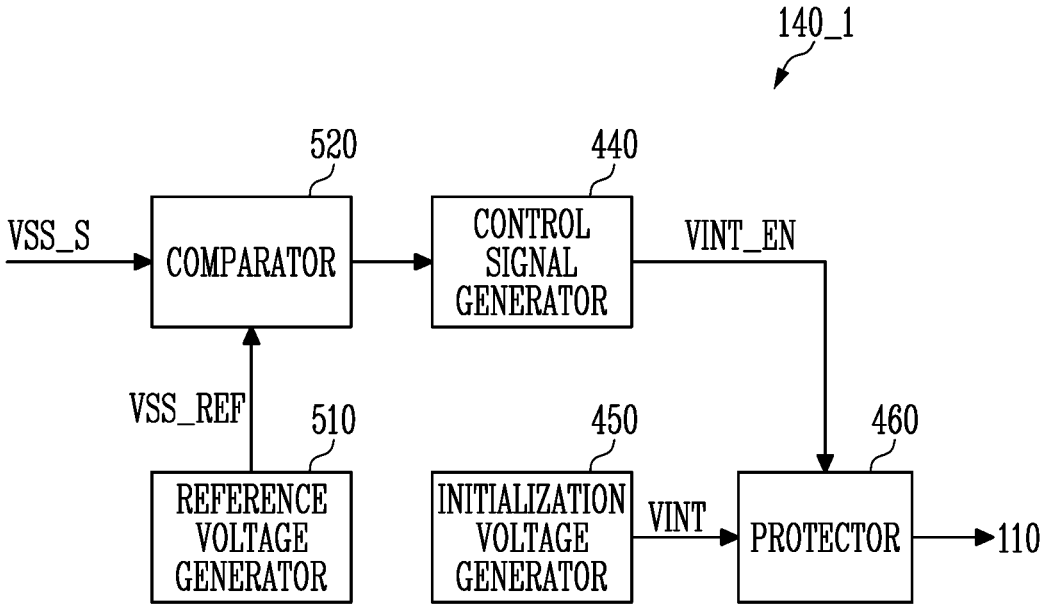
FIG. 4B is a block diagram illustrating another example of the driver included in the display device shown in FIG. 1.

FIG. 4B is a block diagram illustrating another example of the driver included in the display device shown in FIG. 1.

Referring to FIGS. 4A and 4B, a driver 140_1 shown in FIG. 4B may be different from the driver 140 shown in FIG. 4A, in that the driver 140_1 of FIG. 4B includes a reference voltage generator 510 and a comparator 520. The control signal generator 440, the initialization voltage generator 450, and the protector 460 of the driver 140_1 may be the same or substantially the same as those described with reference to FIG. 4A, and therefore, redundant description thereof may not be repeated.

The reference voltage generator 510 (e.g., a reference voltage generating circuit) may generate a reference voltage VSS_REF corresponding to the reference value described above with reference to FIG. 4A. For example, the reference voltage generator 510 may generate the reference voltage VSS_REF based on the gamma power voltage AVDD (e.g., see FIG. 1).

The comparator 520 (e.g., a comparison circuit) may compare a sensing voltage VSS_S (e.g., a voltage at the second power line PL2) with the reference voltage VSS_REF. For example, when the sensing voltage VSS_S is less than or equal to the reference voltage VSS_REF (e.g., when a difference between the sensing voltage VSS_S and the reference voltage VSS_REF is less than an allowable error), the comparator 520 may determine that the second power voltage VSS is normally provided to the second power line PL2. For another example, when the sensing voltage VSS_S is greater than the reference voltage VSS_REF (e.g., when the difference between the sensing voltage VSS_S and the reference voltage VSS_REF is greater than the allowable error), the comparator 520 may determine that the second power voltage VSS is not normally provided (e.g., is abnormally provided) to the second power line PL2.

In other words, the driver 140_1 may determine, in an analog manner, whether the second power voltage VSS is normally provided to the second power line PL2.

Figure 5:
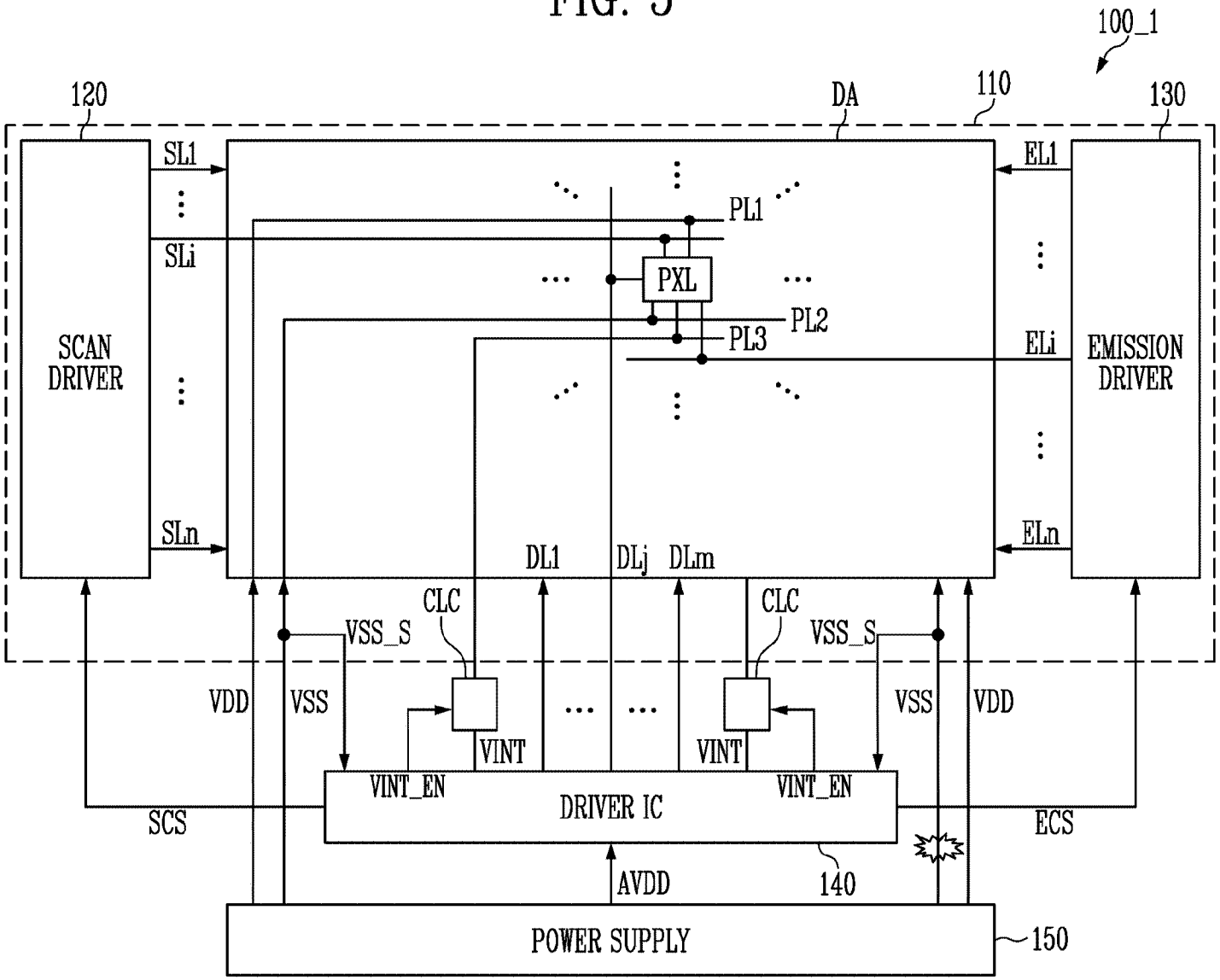
FIG. 5 is a block diagram illustrating a display device in accordance with an embodiment of the present disclosure.

FIG. 5 is a block diagram illustrating a display device in accordance with an embodiment of the present disclosure.

Referring to FIGS. 1 and 5, a display device 100_1 shown in FIG. 5 is different from the display device 100 shown in FIG. 1, in that the display device 100_1 of FIG. 5 includes a current limiter CLC (e.g., a current limiting circuit) as the protection circuit. The display device 100_1 of FIG. 5 is the same or substantially the same as (e.g., or is similar to) the display device 100 shown in FIG. 1, except for the current limiter CLC, and therefore, redundant description thereof may not be repeated.

The current limiter CLC may be connected between the third power line PL3 of the display 110 and the driver 140, and may limit an amount of current flowing between the third power line PL3 and the driver 140 in response to the initialization voltage control signal VINT_EN. For example, the current limiter CLC may include a variable resistance element (e.g., a variable resistor) connected between the third power line PL3 and the driver 140, and may control a resistance of the variable resistance element in response to the initialization voltage control signal VINT_EN. For example, when the second power voltage VSS at the second power line PL2 (e.g., the sensing voltage VSS_S) is abnormal, the current limiter CLC may limit the magnitude of a current flowing in the driver 140 from the display 110 to a suitable or desired magnitude (e.g., a particular or specific magnitude) or less, by increasing the resistance between the third power line PL3 and the driver 140.

Figure 6:
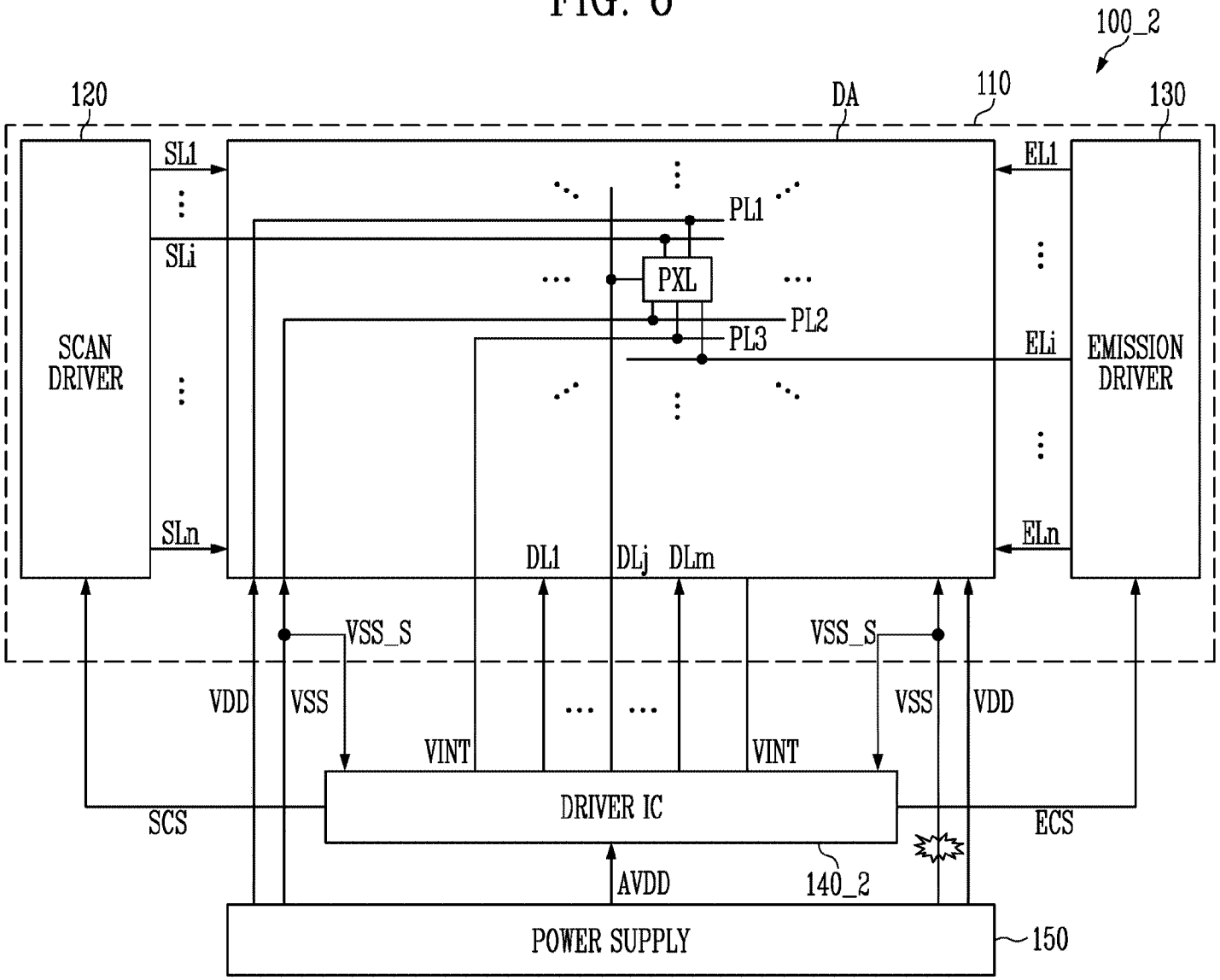
FIG. 6 is a block diagram illustrating a display device in accordance with an embodiment of the present disclosure.
Figure 7:
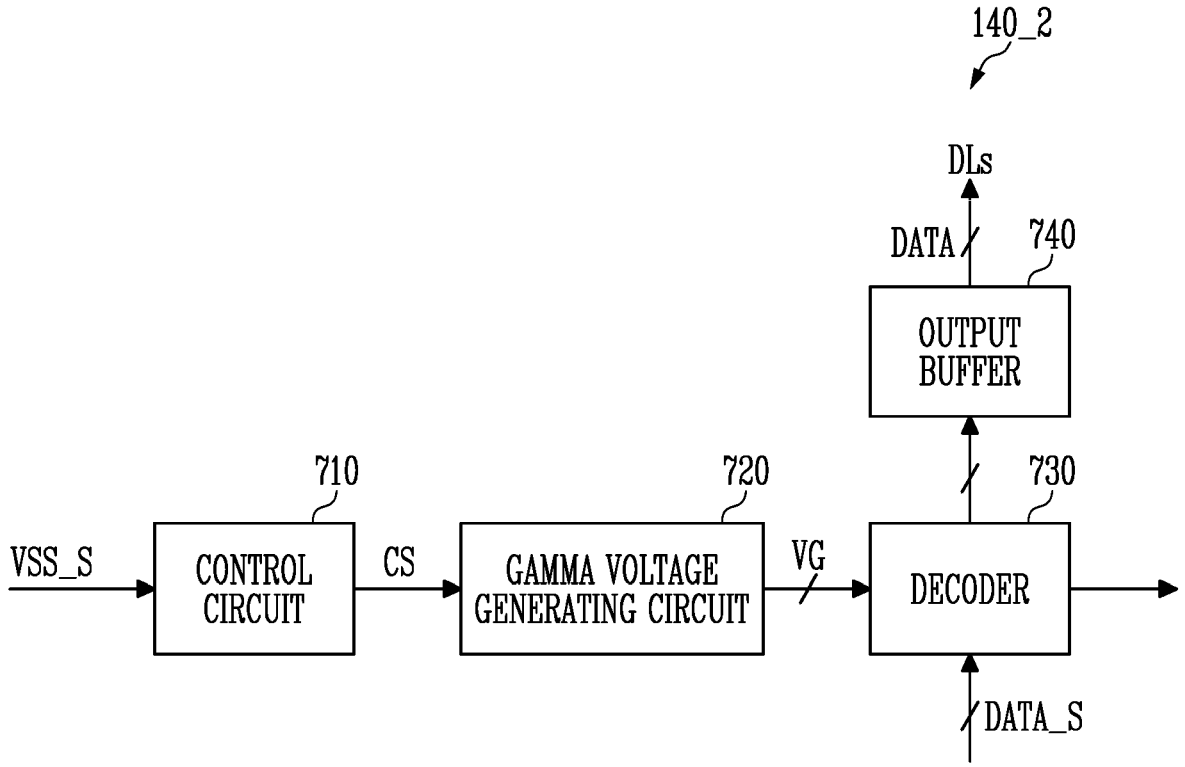
FIG. 7 is a block diagram illustrating an example of a driver included in the display device shown in FIG. 6.
Figure 8A:
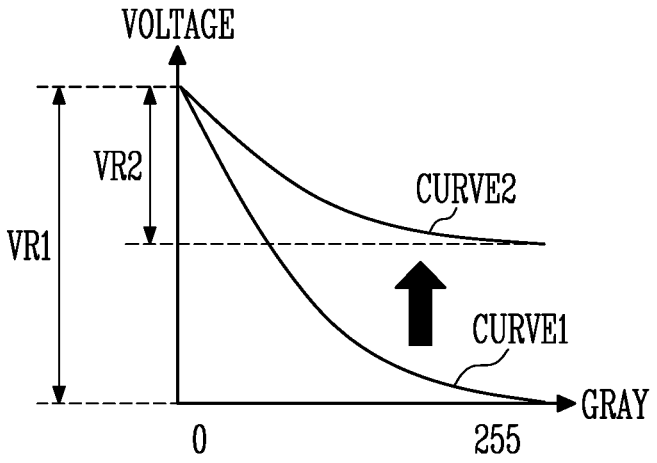
FIG. 8A is a diagram illustrating an example of a gamma voltage generated in the driver shown in FIG. 7.
Figure 8B:
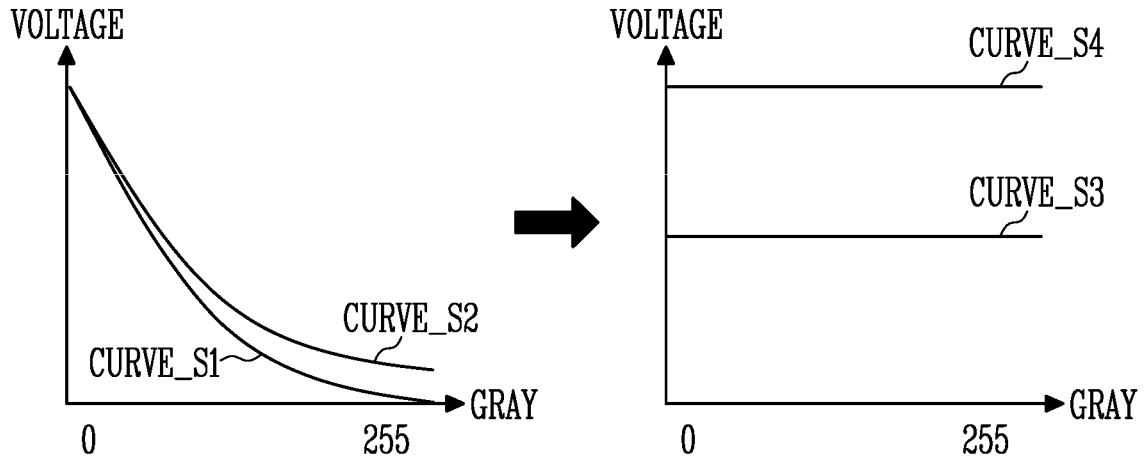
FIG. 8B is a diagram illustrating an example of the gamma voltage generated in the driver shown in FIG. 7.

FIG. 6 is a block diagram illustrating a display device in accordance with an embodiment of the present disclosure. FIG. 7 is a block diagram illustrating an example of a driver included in the display device shown in FIG. 6. A driver 140_2 is briefly (e.g., is partially) illustrated in FIG. 7 based on a configuration for generating a data signal DATA. FIG. 8A is a diagram illustrating an example of a gamma voltage generated in the driver shown in FIG. 7. FIG. 8B is a diagram illustrating an example of the gamma voltage generated in the driver shown in FIG. 7.

Referring to FIGS. 1 and 6, a display device 100_2 shown in FIG. 6 may be different from the display device 100 shown in FIG. 1, in that the display device 100_2 of FIG. 6 may not include the protection circuit and may include the driver 140_2. The display device 100_2 of FIG. 6 is the same or substantially the same as (e.g., or is similar to) the display device 100 shown in FIG. 1, except the driver 140_2, and therefore, redundant description thereof may not be repeated.

The driver 140_2 may control or may vary a voltage range of at least some of the data signals provided to the data lines DL1 to DLm, based on a sensing voltage VSS_S measured at the second power line PL2 of the display 110 (e.g., a voltage level of the second power voltage VSS that is actually applied to the display 110). For example, the driver 140_2 may limit the voltage range of the data signals to a low-grayscale voltage range corresponding to a low luminance. A driving current (e.g., an amount of current) flowing in the pixel PXL (e.g., as described with reference to FIG. 2) may be decreased, an increase in voltage of the anode electrode of the light emitting element LD may be reduced, and an overcurrent flowing in the driver 140_2 through the third power line PL3 may be decreased. Thus, it may be less likely that the driver 140_2 and the display 110 will be damaged.

Referring to FIGS. 6 and 7, the driver 140_2 may include a control circuit 710, a gamma voltage generating circuit 720, a decoder 730 (e.g., a digital-analog converter), and an output buffer 740 (e.g., a buffer circuit).

The control circuit 710 may be connected to the second power line PL2, may measure the second power voltage VSS (e.g., a sensing voltage VSS_S) at the second power line PL2, may determine whether the second power voltage VSS is normally provided to the second power line PL2 based on the sensing voltage VSS_S, and may generate a control signal CS obtained by reflecting a determination result. For example, the control circuit 710 may include the sensing unit 410, the comparator 420, and the storage unit 430 (and the control signal generator 440), which are described above with reference to FIG. 4A, or may include the reference voltage generator 510 and the comparator 520 (and the control signal generator 440), which are described above with reference to FIG. 4B. The control signal CS may correspond to the initialization voltage control signal VINT_EN described above with reference to FIGS. 4A and 4B.

The gamma voltage generating circuit 720 may generate gamma voltages VG having various suitable voltage levels. The gamma voltages VG may be used to covert grayscale values included in image data DATA_S into a data signal DATA (e.g., a data voltage or a grayscale voltage).

The decoder 730 may convert a grayscale value in a digital form, which may be included in the image data DATA_S, into a data signal DATA in an analog form by using the gamma voltages VG. The decoder 730 may be implemented with a digital-analog converter. The image data DATA_S may be provided to the decoder 730, for example, through a shift register and a latch.

The output buffer 740 may output the data signal DATA provided from the decoder 730 to data lines DLs. The data lines DLs may include the data lines DL1 to DLm of the display 110, which are shown in FIG. 6. The output buffer 740 may be implemented to include one or more amplifiers connected to the data lines DLs.

In some embodiments, the gamma voltage generating circuit 720 may vary the gamma voltages VG, based on the control signal CS, or may vary a voltage range of the gamma voltages VG. For example, when the control circuit 710 determines that the second power voltage VSS is normally provided to the second power line PL2, the gamma voltage generating circuit 720 may generate the gamma voltages VG having a first voltage range. For another example, when the control circuit 710 determines that the second power voltage VSS is not normally provided to the second power line PL2, the gamma voltage generating circuit 720 may generate the gamma voltages VG having a second voltage range. In some embodiments, the second voltage range may be a subset of the first voltage range. The second voltage range may correspond to a low luminance that is lower than a total luminance (e.g., or an average luminance) of the first voltage range.

Referring to FIG. 8A, a first curve CURVE1 (e.g., a first gamma curve or a first grayscale-voltage curve) represents voltage levels of the gamma voltage (e.g., or the data signal DATA) according to grayscale values GRAY of the image data DATA_S, when the second power voltage VSS is normal. The gamma voltages VG may have a first voltage range VR1 according to the first curve CURVE1. As described above with reference to FIG. 3A, when the first transistor T1 is implemented with a P-type transistor, the voltage level of the gamma voltage (or the voltage level of the data signal DATA) may be decreased as the grayscale value GRAY increases. However, the present disclosure is not limited thereto. For example, as described with reference to FIG. 3B, when the first thin film transistor M1 is implemented with an N-type transistor, the voltage level of the gamma voltage (or the voltage level of the data signal DATA) may be increased as the grayscale value GRAY increases.

A second curve CURVE2 (e.g., a second gamma curve or a second grayscale-voltage curve) represents voltage levels of the gamma voltage (e.g., or the data signal DATA) according to the grayscale values GRAY of the image data DATA_S, when the second power voltage VSS is not normally provided (e.g., is abnormally provided) to the second power line PL2. The gamma voltages VG may have a second voltage range VR2 according to the second curve CURVE2. The second voltage range VR2 may be a subset of the first voltage range VR1, and may correspond to low grayscale values e.g., grayscale values corresponding to a relatively low luminance) on the first curve CURVE1.

When the second power voltage VSS is not normally provided to the second power line PL2, the gamma voltage generating circuit 720 (e.g., see FIG. 7), or the driver 140_2, may change (e.g., may vary) the voltage range of the data signal DATA from the first voltage range VR1 to the second voltage range VR2. Therefore, as described above, a driving current (e.g., an amount of current) flowing in the pixel PXL may be decreased, an increase in voltage of the anode electrode of the light emitting element LD may be reduced, and an overcurrent flowing in the driver 140_2 through the third power line PL3 may be decreased. Because the voltage range of the gamma voltages VG may be limited (and because the second power voltage VSS is not normally provided to the second power line PL2), an error may occur in an image displayed through the display 110. Thus, a user of the display device 100_2 may recognize that the error has occurred in the display device 100_2, and may not use the display device 100_2 or may take an action to repair the display device 100_2.

In an embodiment, the gamma voltage generating circuit 720 (e.g., see FIG. 7) may generate only a suitable or desired gamma voltage (e.g., a particular or a specific gamma voltage) based on the control signal CS.

Referring to FIGS. 6 and 8B, each of a first sub-curve CURVE_S1 and a second sub-curve CURVE_S2 represents voltage levels of the gamma voltage (e.g., or the data signal DATA) according to grayscale values GRAY of the image data DATA_S, when the second power voltage VSS is normal. Each of a third sub-curve CURVE_S3 (e.g., a third graph) and a fourth sub-curve CURVE_S4 (e.g., a fourth graph) represents voltage levels of the gamma voltage (e.g., or the data signal DATA) according to grayscale values GRAY of the image data DATA_S, when the second power voltage VSS is not normally applied to the second power line PL2.

When the display device 100_2 includes a plurality of pixels that emit light having different colors, the first sub-curve CURVE_S1 and the third sub-curve CURVE_S3 may represent a gamma voltage for a first pixel (e.g., or for first pixels) that emits light of a first color, and the second sub-curve CURVE_S2 and the fourth sub-curve CURVE_S4 may represent a gamma voltage for a second pixel (e.g., or for second pixels) that emits light of a second color.

When the second power voltage VSS is not normally provided to the second power line PL2, the gamma voltage generating circuit 720 (e.g., or the driver 140_2) may change the gamma voltages for the first pixel (e.g., the gamma voltages VG according to the first sub-curve CURVE_S1) to a gamma voltage according the third sub-curve CURVE_S3 (e.g., a minimum gamma voltage corresponding to a minimum grayscale or grayscale value), and may change the gamma voltages for the second pixel (e.g., the gamma voltages VG according to the second sub-curve CURVE_S2) to a gamma voltage according the fourth sub-curve CURVE_S4 (e.g., a gamma voltage corresponding to an intermediate grayscale or grayscale value). In this case, a data signal DATA for the first pixel may be changed to a data voltage corresponding to the minimum grayscale (e.g., a minimum grayscale value), regardless of the grayscale values GRAY, and a data signal DATA for the second pixel may be changed to a data voltage corresponding to the intermediate grayscale (e.g., an intermediate grayscale value), regardless of the grayscale values GRAY. Therefore, a single color image having a particular or specific color (e.g., a red color, a blue color, a green color, or the like) may be displayed through the display 110 shown in FIG. 6, regardless of the image data DATA_S. Accordingly, the user of the display device 100_2 may recognize that an error has occurred in the display device 100_2 (e.g., that the second power voltage VSS is not normally applied to the second power line PL2), and may not use the display device 100_2 or may take an action to repair the display device 100_2.

Although a case where the display 110 displays a single image has been described, the present disclosure is not limited thereto. For example, the gamma voltage generating circuit 720 (e.g., see FIG. 7), or the driver 140_2, may change the gamma voltages VG for all the pixels to a gamma voltage according to the third sub-curve CURVE_S3 (e.g., a gamma voltage corresponding to the minimum grayscale or grayscale value). Therefore, a black image may be displayed in the display 110.

As described with reference to FIGS. 6, 7, 8A, and 8B, when the second power voltage VSS is not normally provided to the display 110, the display device 100_2 (e.g., the driver 140_2) may limit the voltage range of the gamma voltages VG (e.g., or the data signal) to a low-grayscale voltage range corresponding to a low luminance, so that it may be less likely that the driver 140_2 and the display 110 will be further damaged. Further, an abnormal image, a single color image, a black image, or the like may be displayed through the display 110, so that the user of the display device 100_2 may recognize that an error has occurred in the display device 100_2.

Figure 9:
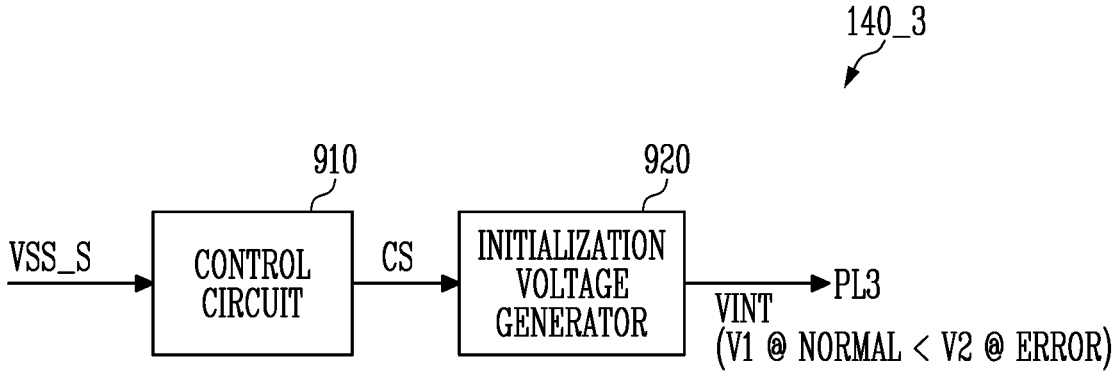
FIG. 9 is a block diagram illustrating another example of the driver included in the display device shown in FIG. 6.

FIG. 9 is a block diagram illustrating another example of the driver included in the display device shown in FIG. 6. A driver 140_3 is briefly (e.g., is partially) illustrated in FIG. 9 based on a configuration for generating the initialization voltage VINT.

Referring to FIGS. 6, 7, and 9, the driver 140_3 shown in FIG. 9 may be different from the driver 140_2 shown in FIG. 7, in that the driver 140_3 of FIG. 9 may control the initialization voltage VINT instead of (or in addition to) the gamma voltages VG.

The driver 140_3 may include a control circuit 910 and an initialization voltage generator 920 (e.g., an initialization voltage generating circuit). The control circuit 910 may be the same or substantially the same as (or similar to) the control circuit 710 described above with reference to FIG. 7, and the initialization voltage generator 920 may be the same or substantially the same as (or similar to) the initialization voltage generator 450 described above with reference to FIG. 4A. Therefore, redundant description thereof may not be repeated, and the differences therebetween may be mainly described hereinafter.

The control circuit 910 may be connected to the second power line PL2, may measure a second power voltage VSS at the second power line PL2 (e.g., a sensing voltage VSS_S), may determine whether the second power voltage VSS is normally provided to the second power line PL2 based on the sensing voltage VSS_S, and may generate a control signal CS obtained by reflecting a determination result.

The initialization voltage generator 920 may be connected to the display 110 (e.g., to the third power line PL3 of the display 110), and may provide the initialization voltage VINT to the display 110.

The initialization voltage generator 920 may change (e.g., may vary) a voltage level of the initialization voltage VINT based on the control signal CS.

For example, when the second power voltage VSS is normal (NORMAL), the initialization voltage generator 920 may generate the initialization voltage VINT to have a first voltage level V1. For example, when the second power voltage VSS is not normally provided (ERROR) to the second power line PL2, the initialization voltage generator 920 may generate the initialization voltage VINT having a second voltage level V2. The second voltage level V2 may be different from the first voltage level V1. For example, in some embodiments, the second voltage level V2 may be higher than the first voltage level V1.

When the second power voltage VSS is not normally provided to the second power line PL2, a voltage of the anode electrode of the light emitting element LD (e.g., described above with reference to FIG. 2) may increase, but the magnitude of an overcurrent flowing in the driver 140_3 through the third power line PL3 may be decreased by the initialization voltage VINT having the second voltage level V2, which may be relatively high.

As described with reference to FIG. 9, when the second power voltage VSS is not normally provided to the display 110, the driver 140_3 may change (e.g., may vary) the voltage level of the initialization voltage VINT, so that it may be less likely that the driver 140_3 and the display 110 will be damaged.

Figure 10:
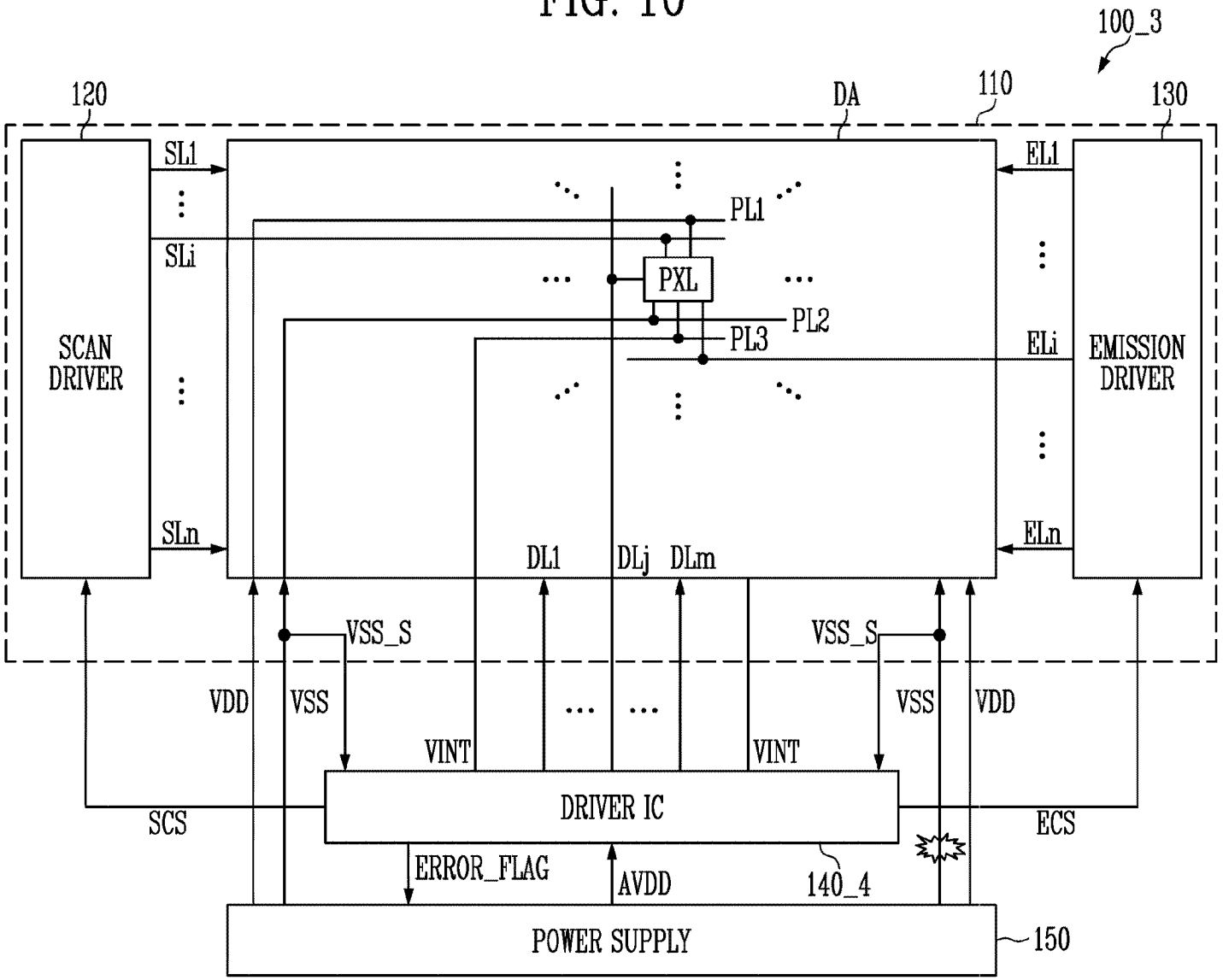
FIG. 10 is a block diagram illustrating a display device in accordance with an embodiment of the present disclosure.

FIG. 10 is a block diagram illustrating a display device in accordance with an embodiment of the present disclosure.

Referring to FIGS. 1 and 10, the display device 100_3 shown in FIG. 10 may be different from the display device 100 shown in FIG. 1, in that the display device 100_3 of FIG. 10 may include a driver 140_4 that generates an error flag ERROR_FLAG (e.g., an error occurrence signal) instead of the initialization voltage control signal VINT_EN. The display device 100_3 may be the same or substantially the same as (or similar to) the display device 100 shown in FIG. 1, except for a configuration for generating the error flag ERROR_FLAG, and therefore, redundant description thereof may not be repeated.

The driver 140_4 may generate the error flag ERROR_FLAG based on a sensing voltage VSS_S measured at the second power line PL2 of the display 110, and may provide the error flag ERROR_FLAG to the power supply 150.

For example, the driver 140_4 may determine whether the sensing voltage SS_S is out of a reference range (e.g., an allowable range), and may generate the error flag ERROR_FLAG when the sensing voltage VSS_S is out of the reference range.

When the power supply 150 receives the error flag ERROR_FLAG, the power supply 150 may stop supplying the first power voltage VDD to the display 110 (e.g., to the first power line PL1). In other words, the power supply 150 may sense that the second power voltage VSS is not normally provided to the second power line PL2, and may not apply the first power voltage VDD to the first power line PL1. In this case, the driving current generating circuit DCG (e.g., described above with reference to FIG. 2) may not generate the driving current (e.g., may not generate any driving current), and an increase in voltage, an increase in temperature, and/or the like at the anode electrode of the light emitting element LD may not occur.

As described with reference to FIG. 10, although a connection error of the second power voltage VSS may occur, the display device 100_3 may interrupt a power source (e.g., the first power voltage VDD) that may generate an overcurrent, so that damage to the driver 140_4 and damage to the display device 100_3 may be prevented or substantially prevented.

Figure 11:
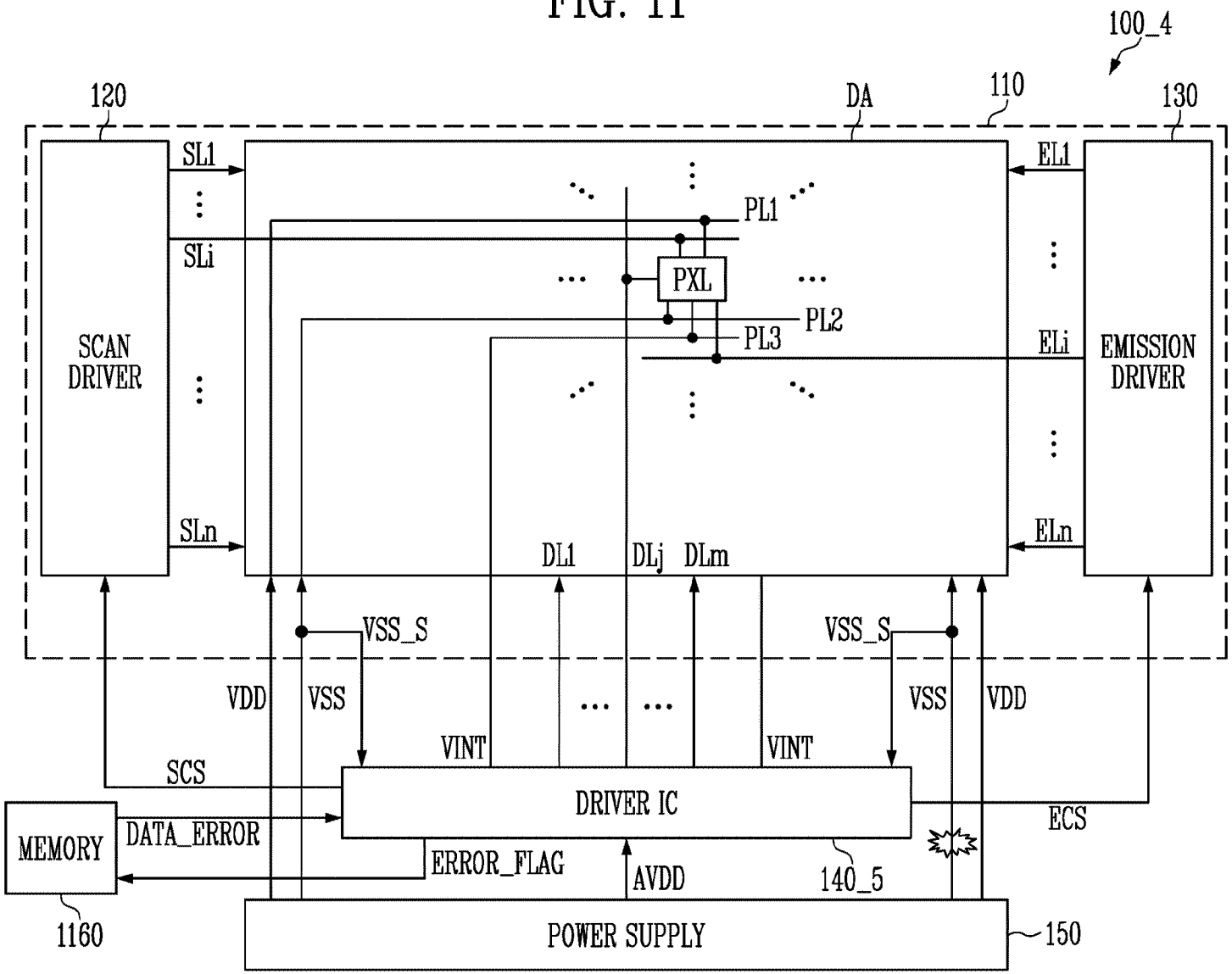
FIG. 11 is a block diagram illustrating a display device in accordance with an embodiment of the present disclosure.

FIG. 11 is a block diagram illustrating a display device in accordance with an embodiment of the present disclosure.

Referring to FIGS. 10 and 11, the display device 100_4 shown in FIG. 11 may be different from the display device 100_3 shown in FIG. 10, in that the display device 100_4 of FIG. 11 may include a memory 1160 (e.g., a memory device). The display device 100_4 of FIG. 11 is the same or substantially the same as (or similar to) the display device 100_3 shown in FIG. 10, except for the memory 1160, and therefore, redundant description thereof may not be repeated.

A driver 140_5 may generate an error flag ERROR_FLAG based on a sensing voltage VSS_S measured at the second power line PL2 of the display 110, and may provide the error flag ERROR_FLAG to the memory 1160.

The memory 1160 may store notification data DATA_ERROR, and may provide the notification data DATA_ERROR to the driver 140_5 in response to the error flag ERROR_FLAG. The notification data DATA_ERROR may be image data corresponding to an error image representing that the second power voltage VSS is not normally provided to the second power line PL2. For example, the error image may include a text such as "VSS connection error," or may include a specific pattern that enables a user to recognize that a VSS connection error exists. For example, the error image may include a black image or a single color image (e.g., a red image). The driver 140_5 may generate a data signal corresponding to the error image, and the display 110 may display the error image.

In other words, the display device 100_4 may replace the image data with the notification data DATA_ERROR, in addition to a configuration for changing (e.g., varying) the voltage range of the gamma voltages VG as described with reference to FIGS. 6 and 7, and a configuration for changing (e.g., varying) the initialization voltage VINT as described with reference to FIG. 9. Thus, a user of the display device 100_4 may recognize that an error has occurred in the display device 100_4.

In accordance with one or more example embodiments of the present disclosure, the display device may supply the initialization voltage to the display panel (e.g., to the pixels) through the driver. When the second power voltage is not normally provided to the display panel, the display device may interrupt the initialization voltage applied to the display panel from the driver through the protection circuit, and/or may limit an amount of current corresponding to the initialization voltage. Thus, a path through which an overcurrent moves between the display panel and the driver, which may be caused by a failure of an electrical connection between the power supply and the display panel, may be interrupted, and damage to the driver (and to the display device) may be prevented or substantially prevented.

In accordance with one or more example embodiments of the present disclosure, when the second power voltage is not normally provided to the display panel, the display device may limit a voltage range of the data signals (or the gamma voltages) to a low-grayscale voltage range corresponding to a low luminance, and may supply a data signal corresponding to an error image (e.g., an error image representing that the second power voltage is not normally provided) to the display panel. Thus, an overcurrent flowing in the display panel from the driver may be decreased, and it may be less likely that the driver (and the display device) will be damaged (e.g., further damaged).

In accordance with one or more example embodiments of the present disclosure, when the second power voltage is not normally provided to the display panel, the display device may interrupt a power source (e.g., the first power voltage), which may generate an overcurrent. Thus, damage to the driver (and to the display device) may be prevented or substantially prevented.

Although some example embodiments have been described, those skilled in the art will readily appreciate that various modifications are possible in the example embodiments without departing from the spirit and scope of the present disclosure. It will be understood that descriptions of features or aspects within each embodiment should typically be considered as available for other similar features or aspects in other embodiments, unless otherwise described. Thus, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Therefore, it is to be understood that the foregoing is illustrative of various example embodiments and is not to be construed as limited to the specific example embodiments disclosed herein, and that various modifications to the disclosed example embodiments, as well as other example embodiments, are intended to be included within the spirit and scope of the present disclosure as defined in the appended claims, and their equivalents.

What is claimed is:

1. A display device comprising:

a display panel comprising a pixel electrically connected to each of a data line, a first power line, a second power line, and a third power line;

a power supply configured to provide a first power voltage to the first power line, and a second power voltage to the second power line; and a driver configured to provide a data voltage to the data line, and a third power voltage to the third power line, wherein the driver is configured to determine whether a sensing voltage measured at the second power line is out of a reference range, and to limit the supply of the third power voltage when the sensing voltage is out of the reference range.

2. The display device of claim 1, wherein the pixel comprises:

a light emitting element connected between the first power line and the second power line;

a driving current generating circuit configured to provide a driving current from the first power line to the light emitting element in response to the data voltage; and an initialization transistor connected between the third power line and one electrode of the light emitting element.

3. The display device of claim 2, wherein the driver is configured to measure the sensing voltage through a routing line branching off from the second power line.

4. The display device of claim 2, further comprising a switch connected between the third power line of the display panel and the driver, wherein the driver is configured to generate a control signal for turning off the switch when the sensing voltage is out of the reference range.

5. The display device of claim 4, wherein the driver comprises:

an analog-digital converter configured to convert the sensing voltage into a sensing value in a digital form;

a comparator configured to compare the sensing value with a reference value; and a control signal generator configured to generate the control signal based on a comparison result of the comparator.

6. The display device of claim 4, wherein the driver comprises:

a reference voltage generator configured to generate a reference voltage;

a comparator configured to compare the sensing voltage with the reference voltage; and a control signal generator configured to generate the control signal based on a comparison result of the comparator.

7. The display device of claim 2, wherein the driving current generating circuit comprises:

a first transistor comprising a first electrode electrically connected to the first power line through a second node, a second electrode electrically connected to the one electrode of the light emitting element through a first node, and a gate electrode electrically connected to a third node;

a second transistor comprising a first electrode connected to the data line, a second electrode connected to the second node, and a gate electrode connected to a scan line;

a third transistor comprising a first electrode connected to the first node, a second electrode connected to the third node, and a gate electrode connected to the scan line; and a storage capacitor between the first power line and the third node.

8. The display device of claim 2, wherein the driving current generating circuit comprises:

a first transistor comprising a first electrode electrically connected to the first power line, a second electrode electrically connected to the one electrode of the light emitting element, and a gate electrode connected to a gate node;

a second transistor comprising a first electrode connected to the data line, a second electrode connected to the gate node, and a gate electrode connected to a scan line; and a storage capacitor between the gate node and the one electrode of the light emitting element.

9. The display device of claim 2, further comprising a current limiting circuit connected between the third power line of the display panel and the driver, wherein the driver is configured to generate a control signal to allow the current limiting circuit to limit an amount of current flowing through the third power line, when the sensing voltage is out of the reference range.

10. The display device of claim 1, wherein the driver is configured to vary the third power voltage when the sensing voltage is out of the reference range.

11. The display device of claim 1, wherein a voltage level of the first power voltage is greater than that of the second power voltage.

12. A display device comprising:

a display panel comprising a pixel electrically connected to each of a data line, a first power line, a second power line, and a third power line;

a power supply configured to provide a first power voltage to the first power line, and a second power voltage to the second power line; and a driver configured to provide a data voltage to the data line, and a third power voltage to the third power line, wherein the driver is configured to determine whether a sensing voltage measured at the second power line is out of a reference range, and to vary the data voltage from a first voltage range to be within a second voltage range different from the first voltage range.

13. The display device of claim 12, wherein the second voltage range is a subset of the first voltage range, and wherein the second voltage range corresponds to a low luminance that is lower than an average luminance of the first voltage range.

14. The display device of claim 13, wherein the driver is configured to change the data voltage to correspond to a minimum grayscale when the sensing voltage is out of the reference range.

15. The display device of claim 13, wherein the display panel comprises a plurality of pixels comprising first pixels configured to emit light of a first color, and second pixels configured to emit light of a second color, and wherein the driver is configured to change a data voltage of the first pixels to correspond to a minimum grayscale, and a data voltage of the second pixels to correspond to an intermediate grayscale greater than the minimum grayscale.

16. The display device of claim 12, wherein the driver comprises:

a control circuit configured to determine whether the sensing voltage is out of the reference range;

a gamma voltage generating circuit configured to generate gamma voltages, and to vary a voltage range of the gamma voltages based on a determination result of the control circuit; and an analog-digital converter configured to generate the data voltage based on the gamma voltages and a grayscale value included in image data and corresponding to the pixel.

17. The display device of claim 12, further comprising a memory configured to store notification data, wherein the driver is configured to generate the data voltage based on the notification data when the sensing voltage is out of the reference range, and wherein the notification data corresponds to an error image representing that the second power voltage is not normally provided to the second power line.

18. The display device of claim 17, wherein the error image comprises a black image, a single color image, a pattern image, or a pattern.

19. A display device comprising:

a display panel comprising a pixel electrically connected to each of a data line, a first power line, a second power line, and a third power line;

a power supply configured to provide a first power voltage to the first power line, and a second power voltage to the second power line; and a driver configured to provide a data voltage to the data line, and a third power voltage to the third power line, wherein the driver is configured to determine whether a sensing voltage measured at the second power line is out of a reference range, and to generate a control signal when the sensing voltage is out of the reference range, and wherein the power supply is configured to interrupt the supply of the first power voltage in response to the control signal.

* * * * *